United States Patent [19]

Muller

[11] 4,045,942

[45] Sept. 6, 1977

[54] APPARATUS FOR FORMING A WRAPPER ABOUT A GROUP OF ARTICLES

[75] Inventor: Rolf Muller, Trier-Ehrang, Germany

[73] Assignee: The Mead Corporation, Dayton, Ohio

[21] Appl. No.: 685,051

[22] Filed: May 10, 1976

[30] Foreign Application Priority Data

May 9, 1975 Germany ..... 2520625

[51] Int. Cl.[2] ..... B65B 21/24

[52] U.S. Cl. ..... 53/48

[58] Field of Search ..... 53/48

[56] References Cited

U.S. PATENT DOCUMENTS 3,203,153 8/1965 Wood ..... 53/48

3,701,230 10/1972 Gentry ..... 53/48

*Primary Examiner*—Travis S. McGehee

*Attorney, Agent, or Firm*—Walter M. Rodgers; Walter A. Rodgers

[57] ABSTRACT

Apparatus for forming a wrapper about a group of articles, the wrapper having a top wall, side walls, bottom panels, end flaps, and a pair of outer flap parts integral with each end flap, the apparatus comprising means for moving the wrappers along a continuous path, a pair of fold elements pivotally mounted and adapted to fold the end flaps in an upward direction by a first cam means, and the fold elements being adapted to swing inwardly by a second cam means and thereby to press the outer flap parts against the associated side wall.

4 Claims, 9 Drawing Figures

APPARATUS FOR FORMING A WRAPPER ABOUT A GROUP OF ARTICLES

Figure 1:
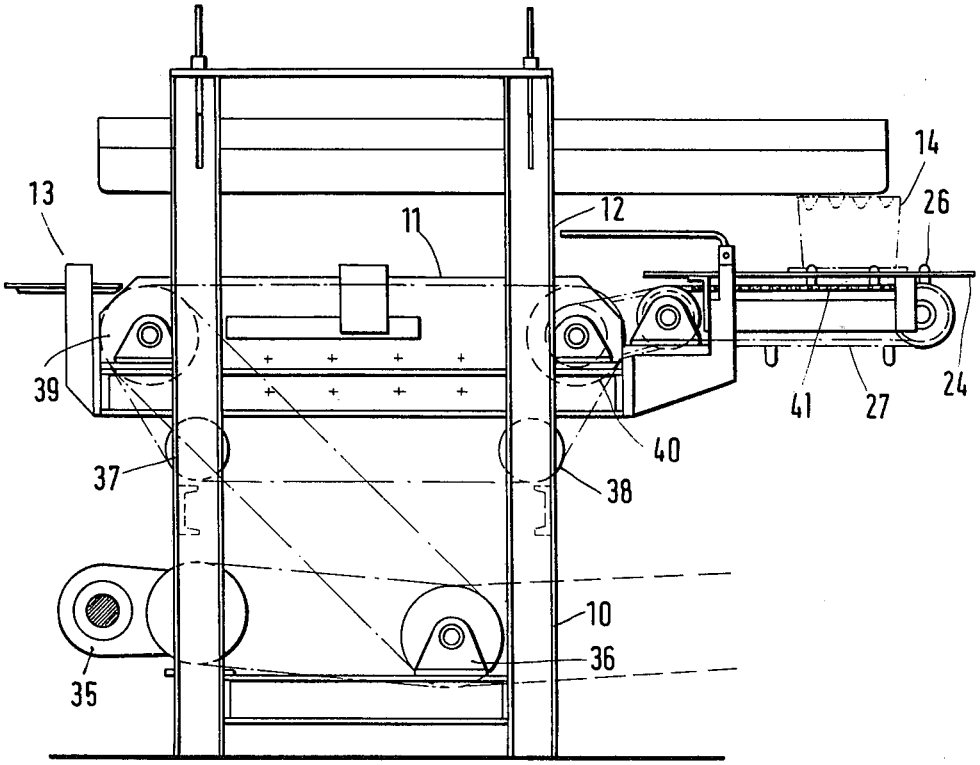

It is known in the art to produce wrappers for articles with the wrappers being suitable both for transport and for display purposes. In a conventional apparatus the pre-grouped articles are first inserted into the article carrier through an end thereof and then conveyed in a direction perpendicular to the original line of travel. The apparatus operates on a continuous basis, however, the articles to be packed are subjected to a change of direction which tends to slow production.

Another prior art apparatus operates according to the lifting principle. According thereto the wrappers are loaded with articles in one plane and then the entire unit is lowered by segments.

In all conventional systems the article carrier changes direction of movement during the production process thereby rendering higher speeds of production difficult as the friction between the packing material and the conveyor elements and the mass acceleration in different directions place extremely high requirements upon the quality of the material of the wrapper.

Moreover, the state-of-the-art arrangements require considerable space and several operators.

Basic to the invention is the problem of providing a process and an apparatus of the afore-mentioned type to reduce the load upon the material of the wrappers and to increase the speed of production.

This problem is solved in that end flaps folded to the bottom of the wrapper and extending transverse of the direction of movement of the wrapper are folded perpendicularly upwardly, and the outer flap parts are respectively folded laterally and are then connected to the side walls of the wrapper, with the fold cover maintaining the direction of movement and position.

According to this invention an apparatus is provided wherein in a frame a conveying plane compresses an entrance and an exit for the wrapper which moves by laterally guided chains rotating in parallel, cam surfaces firmly mounted on a base plate and secured to the frame so that a first of fold elements entering the conveyor plane rotate against the conveying direction of the chains, a second pair of fold elements at the same point in time rotates in the conveying direction of the chains from a horizontal into a vertical position, and both pairs of the fold elements at the same time move transverse to the direction of conveyance.

In another aspect of the apparatus an intake is provided and comprises two sliding rails disposed in parallel spaced relationship and a conveying chain rotating between the sliding rails and provided with bolts and with the bolts adapted to engage holes in the bottom of the wrapper.

This, advantageously, permits a simple connection of the apparatus to premolding machines for the wrapper; conversely, the said intake permits the use of the machine as a single aggregate.

The advantages adapted to be obtained with the invention in particular reside in a higher production speed with a lower material load on the wrapper, lower space and staff requirements, and higher operational security.

Figure 2:
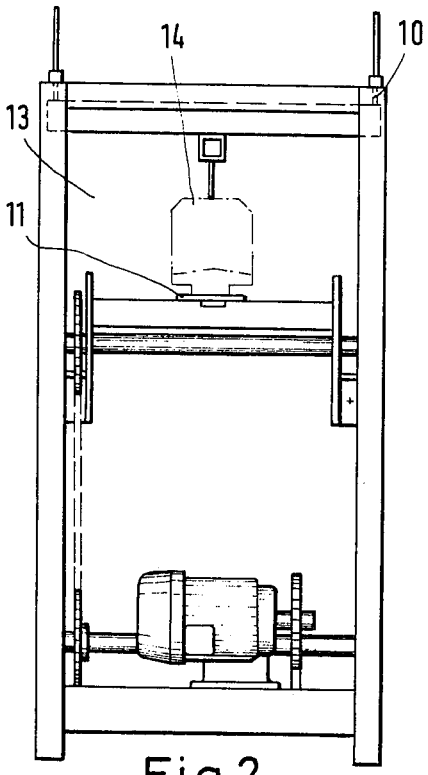
Figure 3:
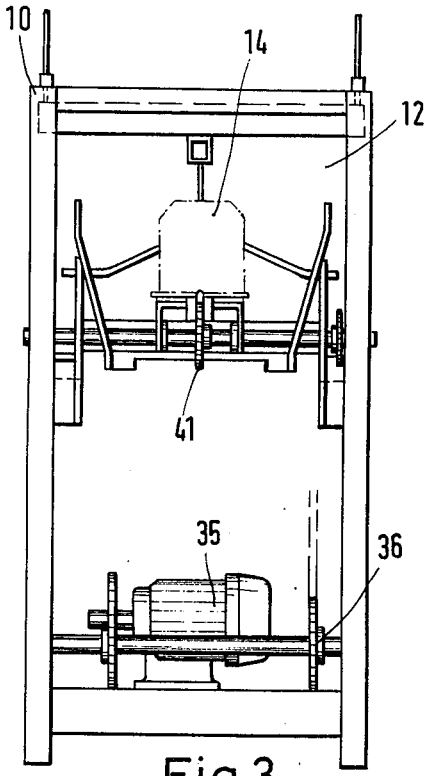
Figure 4:
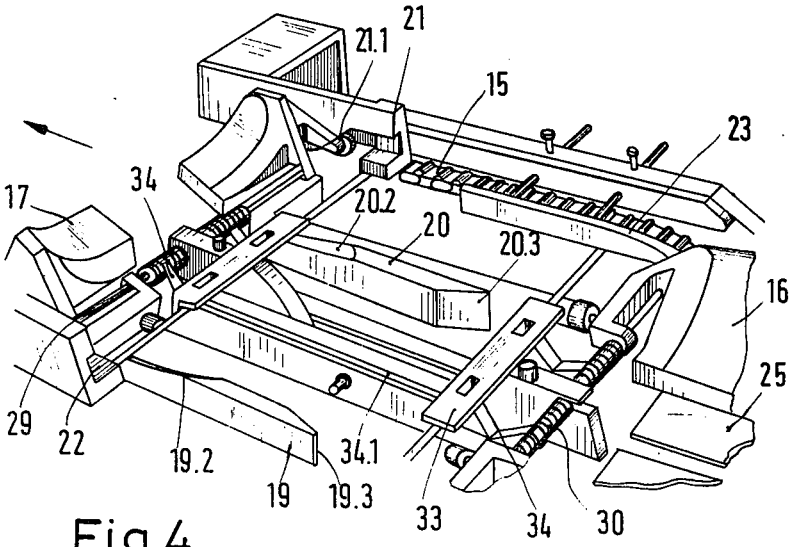
Figure 5:
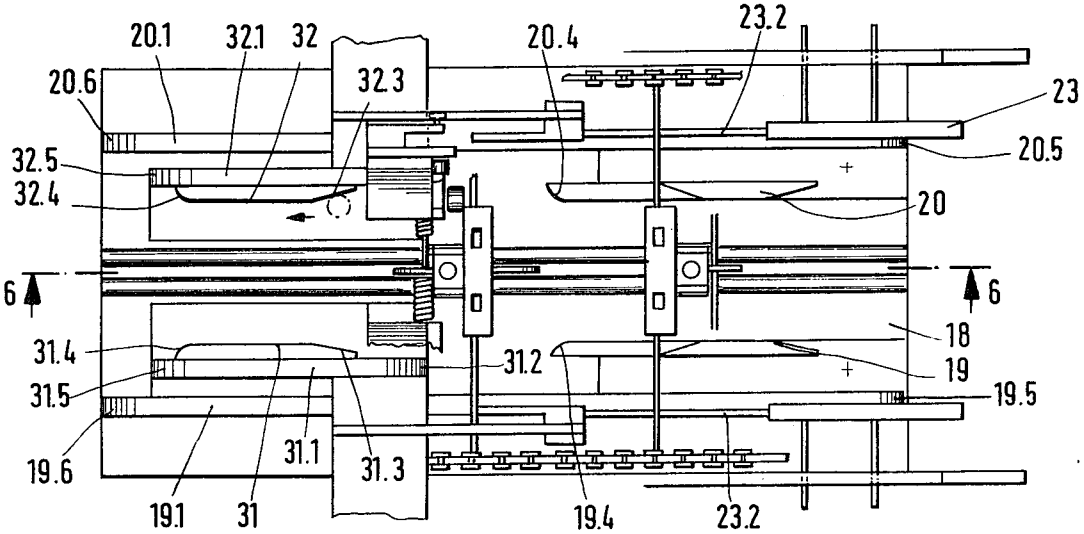
Figure 6:
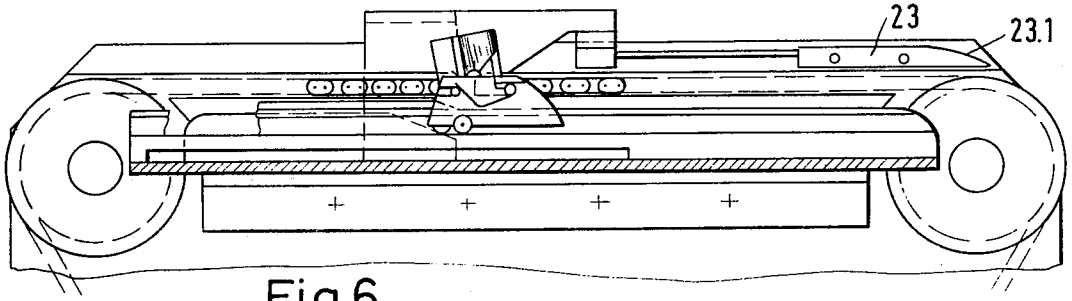

One form of embodiment of the invention is demonstrated in the drawing and subsequently is described in greater detail, wherein FIG. 1 is a schematic side view of the apparatus FIG. 2 is a schematic view of the exit of the apparatus FIG. 3 is a schematic view of the entrance of the apparatus FIG. 4 is a perspective view of the conveying plane of the apparatus FIG. 5 is a plan view of the conveying plane FIG. 6 is a sectional view along the line 6-6 in FIG. 5

Figure 9:
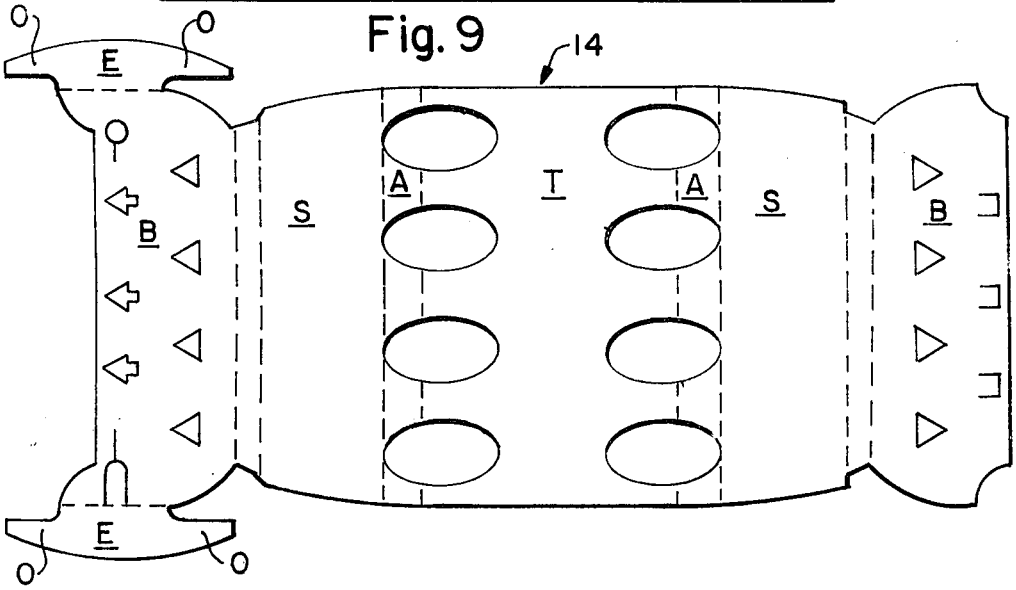
Figure 8:
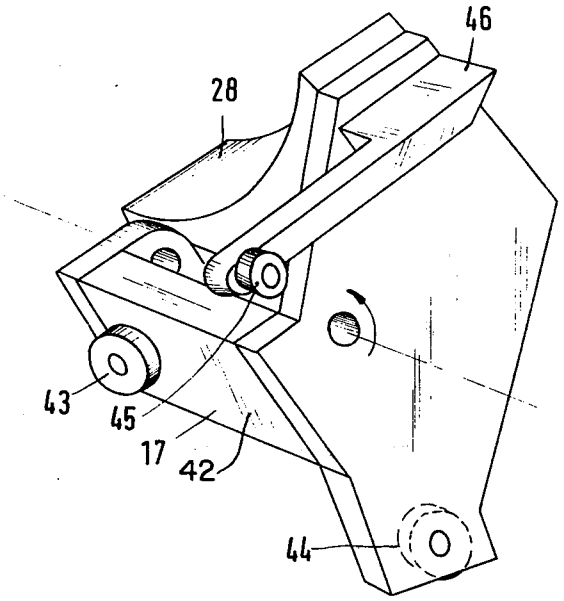
Figure 7:
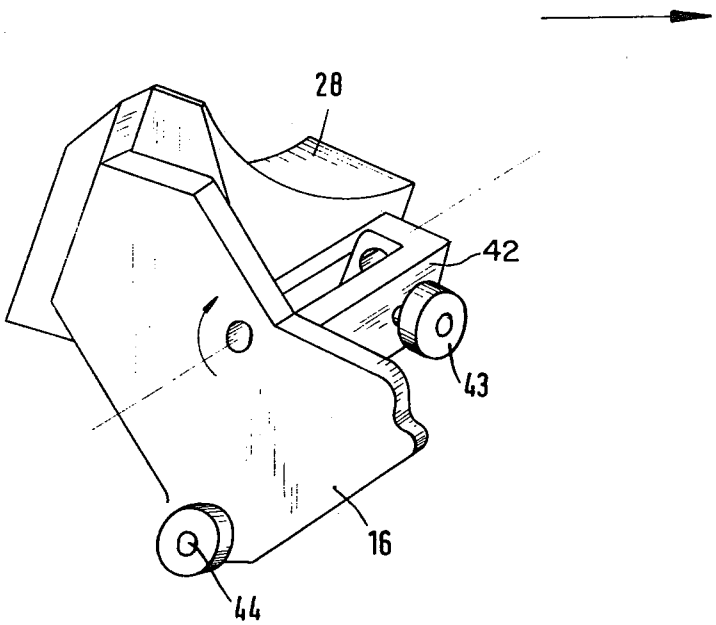

FIG. 7 is a perspective illustration of a fold element for engagement with the front side which is seen in the direction of movement is the rear side FIG. 8 is a perspective view of a fold element for engagement with the front side which, seen in the direction of movement is the forward side and wherein FIG. 9 is a plan view of a wrapper blank to which the apparatus of this invention is applicable.

This invention is especially adapted to form a wrapper type article carrier such as is shown in FIG. 9 about a group of articles. More specifically the wrapper 14 is provided with top wall T to the side edges of which top sloping panels A are foldably joined respectively. Side walls S are foldably joined to the edges of top sloping panel A remote from top wall T. Bottom panels B are foldably joined respectively to the lower edges of side walls S. To the end edges of one bottom panel B, end flaps E are foldably joined respectively. In addition an outer flap part 0 is integrally formed on each end of end flaps E.

The apparatus includes a frame 10 in the lower portion of which is disposed a drive in the form of an electromotor 35. Disposed in the central portion of the welded frame structure is a base plate 18 on which are provided cam surfaces 19, 20, 21, 22, 23, 31, 32, 20.1, 19.1, 31.1 and 32.1. The fold elements 16,17 are secured by means of axes 29 to lateral chains 15 guided in parallel over sprockets. Cam surfaces 23, 21, 22, 32, 31, 31.1 and 32,1 act in coordination with fold element 17 and the cam surfaces 19.1., 20.1, 19 and 20 act in coordination with fold element 16. The fold elements form fold stations and in which the front and rear front walls of a wrapper are sealed.

The conveying chains are driven by four sprockets 37, 38, 39, 40 at each side of the apparatus above and below the base plate 18.

Provided on the base plate 18 are the cam surfaces required for the control of the fold elements 16, 17. At the entrance 12 of the apparatus on both sides thereof is arranged a cam surface 23 which at the front ends thereof has a horizontally curved intake face 23.1 of a constant width.

The cam surfaces 23 engage the arms 46 of the fold element 17 to move the fold element into a horizontal position and, by means of the cam surfaces 23 and the connecting elements 23.2 maintain the same in a horizontal position until the cam follower 45 engage the cam surfaces 21 and 22, respectively, to initiate the erection movement of the fold element.

Provided in parallel to the cam surfaces 23 but farther toward the central line and further in the conveying direction of the apparatus are tapered cam surfaces 19, 20 which at the rear parts thereof comprise curved faces 20.2 and 19.2, respectively. The tapered faces 20.3 and 19.3 are in alignment with the central line of the apparatus. The other ends of the cam surfaces 19,20 are composed of curved faces 19.4 and 20.4, respectively.

Provided in parallel to the cam surfaces 19, 20 but further outwardly and remote from the central line of the apparatus and starting approximately at the end of the cam surfaces 19, 20 (with this point being dependent on the size of the wrappers to be processed) are cam surfaces 21, 22 which form a horizontal intake which are followed by downwardly inclined faces 21.1 and 22.1 (not shown), respectively. These cam surfaces engage the cam followers 45 of the arms 46 of the fold element 17 to initiate the movement of erection of the fold element. The movement of erection is then completed by the engagement of the cam follower 44 with the front, horizontally curved faces 31.2 and 32.2 (not shown), respectively of the cam surfaces 31.1 and 32.1.

Provided in parallel to the cam surfaces 21, 22 but farther in the conveying direction, are cam surfaces 31, 32. The cam surfaces 31, 32 at the front ends thereof (seen in the conveying direction) comprise a vertically oblique face 31.3 and 32.3, respectively and at the rear end include curved faces 31.4 and 32.4. The curved faces 31.4 and 32.4 respectively are followed — but laterally staggered outwardly — by a curved faces 31.5 and 32.5.

Provided ahead of the cam surfaces 23 is an intake path 24 which is composed of two spaced sliding rails and provided with a conveying chain 41 extending therebetween which includes bolts 26. The cam surfaces 31, 32 are followed by an outlet path.

The fold elements 16, 17 are secured to the chains 15. The fold elements are composed of a base body 42 and inserted fold jaws 28 made of plastic material. The fold jaws can be of a variable configuration so that at any time they are in line with the form of the articles. Secured to the base body are cam followers 43, 44. The fold element which engages the front side of the wrapper has a guide arms 46 with a pair of cam followers 45 secured thereto to erect pair of the fold element 17 against the direction of movement. To permit the erection of the fold element 17 the cam surfaces 19, 20 are provided with a horizontally tapered face to supply the space required for the movement of erection.

The fold elements are disposed displacably on the axes 29 and are biased by means of helical springs 30.

Laterally provided at the intake path are means for applying an adhesive to the side faces of the wrapper.

A partly sealed wrapped 14 loaded with articles, such as glasses, tins, bottles etc. is passed into the intake track 24. The bolts 26 of the conveying chain 41 engage holes in the bottom of the wrapper and convey the wrapper toward the entrance 12 of the apparatus.

At the entrance 12 the fold cover is engaged by the fold elements 16, 17 which, after the auxiliary fold elements 34 having lifted the front end flap E and the rear end flap E by rotation through control rails 34.1 in the direction and counter direction, respectively, of conveyance. The front curved faces 19.5 and 20.5 move the fold element 16 into the vertical position by means of cam followers 44.

The front oblique faces 19.3 and 20.3, respectively move the fold elements 16 transverse of the direction of movement toward the wrapper to connect the outer flap parts O with the side walls S. In synchronism with this movement the fold elements 17 are erected through the cam surfaces 21.1 and 22.1 in that the cam followers 45 engage the cam surfaces 21.1 and 22.1 respectively. The initiated movement of erection is followed by the complete movement of erection in that the cam followers 44 of the fold element 17 engage the cam surfaces 31.2 and 32.2, respectively. This movement of erection is followed by a movement transverse of the direction of movement which is achieved by means of the tapered cam surfaces 31.3 and 32.3, respectively, engaging the cam followers 43 of the fold element 17.

When the fold elements 16, 17 reach the cam surfaces 19.4, 20.4 and 31.4, 32.4, respectively the wrapper is released. By means of the cam surfaces 19.6 and 20.6, respectively which are curved, and by the control faces 31.5 and 32.5 which are equally curved, a movement of rotation of the fold elements in the direction or counter direction of conveyance is effected whereby the fold elements finally release the wrapper.

Laterally provided at the intake track are means for applying an adhesive to the side faces of the wrapper at points which engage the adhesive flap of the front wall. Equally it is possible to apply the adhesive directly to the adhesive flap. Further, it is possible to place the sealing flap into engagement with the side wall by means of a bracket or a fishplate.

While the wrapper is conveyed by the apparatus the fold elements remain in the press position until a connection of the adhesive flaps to the side walls has been achieved. At the end of the conveyor plane the fold elements are released whereby the wrapper is passed into the exit of the apparatus for further packing purposes.

The system as described and demonstrated permits the production of article carriers at higher speeds. The space and staff requirement is low and the load on the material of the wrapper is minimized as the wrapper during the production of the article carrier maintains its position.

I claim:

1. Apparatus for forming article carriers of the wraparound type having a top wall, side walls, bottom panels, end flaps foldably joined to the opposite end edges of one of said bottom panels, said end flaps being provided respectively with a pair of outer flap parts and adapted for attachment respectively to said side walls, said apparatus comprising conveyor means on which the carrier is advanced in continuous motion with said side walls of the package being disposed parallel to the direction of travel, a pair of auxiliary fold elements arranged respectively to fold upwardly said end flaps, fold elements pivotally mounted respectively on rods extending transverse to the direction of travel, said rods being pivotally mounted at each end thereof on endless elements which extend parallel to the direction of travel, each of said fold elements having at least one cam follower adapted to engage a cam surface to swing said fold elements upwardly, and wherein the improvement resides in moving said fold elements (16, 17) inwardly in a directly transverse to the direction of travel by means of second cam followers (43) secured respectively to said fold elements and controlled respectively by second cam surfaces (31, 32) to press said outer flap parts against the side walls of the carrier.

2. Apparatus according to claim 1 wherein said fold elements (16, 17) respectively comprise a pair of fold jaws (28).

3. Apparatus according to claim 2 wherein said fold jaws (28) are adapted respectively to press said outer flap parts against said side walls.

4. Apparatus according to claim 1 wherein a helical spring is mounted on each of said rods to urge each pair of said fold jaws in respective opposite directions.

* * * * *